US009650773B1

(12) United States Patent
Huang

(10) Patent No.: US 9,650,773 B1
(45) Date of Patent: May 16, 2017

(54) LEAK-PROOF STRUCTURE OF TOILET TANK

(71) Applicant: So-Mei Huang, Tai Ping (TW)

(72) Inventor: So-Mei Huang, Tai Ping (TW)

( * ) Notice: Subject to any disclaimer, the term of this patent is extended or adjusted under 35 U.S.C. 154(b) by 0 days.

(21) Appl. No.: 15/004,664

(22) Filed: Jan. 22, 2016

(51) Int. Cl.

| | |
|---|---|
| ***E03D 1/32*** | (2006.01) |
| ***E03D 1/36*** | (2006.01) |
| ***E03D 11/00*** | (2006.01) |
| ***E03D 5/02*** | (2006.01) |

(52) U.S. Cl.
CPC ..... *E03D 1/36* (2013.01); *E03D 1/32* (2013.01); *E03D 5/02* (2013.01); *E03D 11/00* (2013.01)

(58) Field of Classification Search
CPC .... E03D 5/02; E03D 1/36; E03D 1/32; E03D 11/02; E03D 11/00; E03D 11/18
See application file for complete search history.

(56) References Cited

U.S. PATENT DOCUMENTS

| | | | | |
|---|---|---|---|---|
| 5,862,538 | A * | 1/1999 | Ho | E03D 1/36 137/441 |
| 6,934,977 | B1 * | 8/2005 | Quintana et al. | E03D 1/00 4/366 |
| 7,464,415 | B2 * | 12/2008 | Randolph | E03D 1/36 137/426 |
| 8,209,792 | B1 * | 7/2012 | Quintana et al. | E03D 1/00 4/420 |
| 8,418,276 | B2 * | 4/2013 | Huang | E03D 5/02 4/405 |
| 9,303,782 | B2 * | 4/2016 | Stoltz et al. | E03D 11/00 |

* cited by examiner

*Primary Examiner* — Kevin Lee
(74) *Attorney, Agent, or Firm* — Guice Patents PLLC

(57) ABSTRACT

A leak-proof structure of a toilet tank, including a self-sealing actuating device, a string set and a water control device. When the water inlet valve is failure, the water control device is pulled by an end of the inner string of the string set driven by the buoyant cover of the self-sealing actuating device, and a column is released to restore a torsion spring, a shaft is driven to rotate to a stopped water position by the restoring elasticity, and the automatic stop-leaking purpose is achieved.

7 Claims, 8 Drawing Sheets

LEAK-PROOF STRUCTURE OF TOILET TANK

BACKGROUND OF THE INVENTION a) Field of the Invention

The invention relates to a leak-proof structure of a toilet tank and, more particularly, to a leak-proof of the toilet tank with self-sealing function, which is provided to stop water flowing into the toilet tank when a water inlet valve of the toilet tank is broken, to achieve automatic stop-leaking purpose.

b) Description of Prior Art

Water shortage problem is increasingly severe in recent years. Governments at all levels mostly charge a fine as punishment for wasting water to remind the importance of saving water. Except a washing machine, a toilet tank is the place that consumes most water in a common family. An abnormal water-consuming situation of a toilet tank is usually the most inconspicuous one, so that consumers usually find water leakage after it happens for a long period of time, there is a punitive fine and it is also unnecessary waste of water resources.

One of the main reasons of water leakage is that the water inlet valve of the toilet tank is broken. If a large amount of water leakage is not immediately stopped, water rate may become huge water rate. Although, some solutions have been proposed for avoiding this kind of water leakage situation in industry, there is no ideal results so far.

SUMMARY OF THE INVENTION

In view of this, the invention relates to a leak-proof structure of a toilet tank, namely, the object of the invention is to provide a leak-proof of the toilet tank with self-sealing function, which is provided to stop water flowing into the toilet tank when a water inlet valve of the toilet tank is broken, to achieve automatic stop-leaking purpose.

To achieve the object, the leak-proof structure of the toilet tank of the present invention, including a self-sealing actuating device, a string set and a water control device, wherein:

the self-sealing actuating device, which is installed on an upper side of an overflow pipe, the self-sealing actuating device is consisted of a buoyant cover, a holder and an outer fixed plate, a connecting arm is extendedly connected to a side of the buoyant cover, an inner shaft hole is set on the connecting arm; a first side arm, a second side arm and a first holding portion are set on the holder, a first containing cavity and a support shaft are set on the second side arm, the support shaft is inserted into the inner shaft hole, a second holding portion is set on the outer fixed plate, the overflow pipe is held by the second holding portion and the first holding portion are correspondingly, to thereby fasten the self-sealing actuating device;

the string set, which is consisted of an outer tube and an inner string, the outer tube is a hollow tube body, a first joint is set on an end of the outer tube, the first joint is connected to the holder of the self-sealing actuating device, a second joint is set on another end of the outer tube, the inner string is passed through inside the outer tube, two ends of the inner string is outstretched out of two ends of the outer tube, a first gland is set on the end of the inner string, the first gland is placed inside the first containing cavity, a second gland is set on another end of the inner string;

the water control device, which is set on a connecting location of an inlet pipe and a water inlet valve on an outer bottom side of a toilet tank, the water control device includes:

a water control box, which is consisted of a box body, a swiveling cover, a fixed nut and an engaging tube; an inner containing room is set inside the box body, the swiveling cover is covered on a side of the box body, an open-end hole is set on a top side of the box body, an lower section of the engaging tube is passed through the fixed nut and then placed into the open-end hole, the fixed nut is fastened to a screw tube, a screw pipe is set on a bottom of the box body, the screw pipe is fastened to an inlet pipe;

a sealing valve, which is placed in the inner containing room of the box body, the sealing valve is consisted of an outer sleeve, a shaft, a movable slider, a fixed slider and a pad, a shaft hole is set on the outer sleeve, an outlet hole is further set on a peripheral edge of the outer sleeve, a shaft head is set on a upper section of the shaft, a shafting block and an outlet notch are set on a lower section of the shaft, the shaft head is passed through the shaft hole, a shifting groove and at least a gap are set on the movable slider, the shifting block is embedded in the shifting groove, the fixed slider is attached to a bottom side of the movable slider, at least a water hole is set on the fixed slider, the pad is attached to a bottom side of the fixed slider;

a seat group, which is consisted of a disc seat, a fixed disc, a pushing block, a spring and a torsion spring, a positioning hole is set on a peripheral edge of a disc body of the disc seat, a stepped convex seat is set in the center of the disc body, the shaft head of the shaft is placed inside the stepped convex seat, the torsion spring is set between the disc seat and the swiveling cover, a central hole is set on the fixed disc, a side sleeve is set on a side of the fixed disc, the side sleeve includes a mounting hole, the pushing block is placed in the mounting hole, a second containing cavity set on a peripheral edge of the pushing block is provided to place the second gland of the inner string, a column is set on a front end of the pushing block, the column is corresponded to the positioning hole, the spring is passed through by the inner string, the spring is touched a bottom of the pushing block.

DETAILED DESCRIPTION OF THE INVENTION

Figure 1:
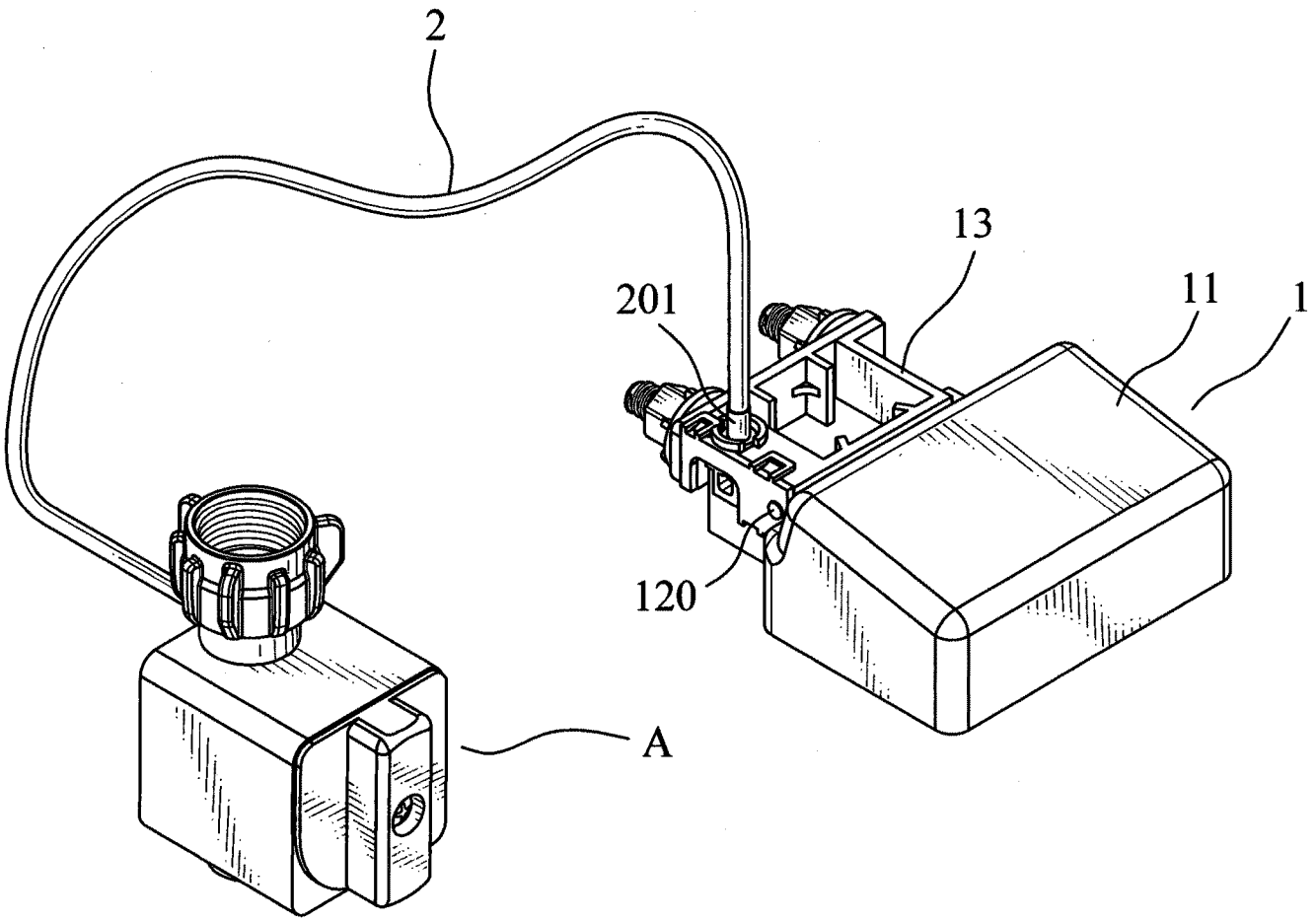
FIG. 1 is a three-dimension diagram of the present invention.
Figure 2:
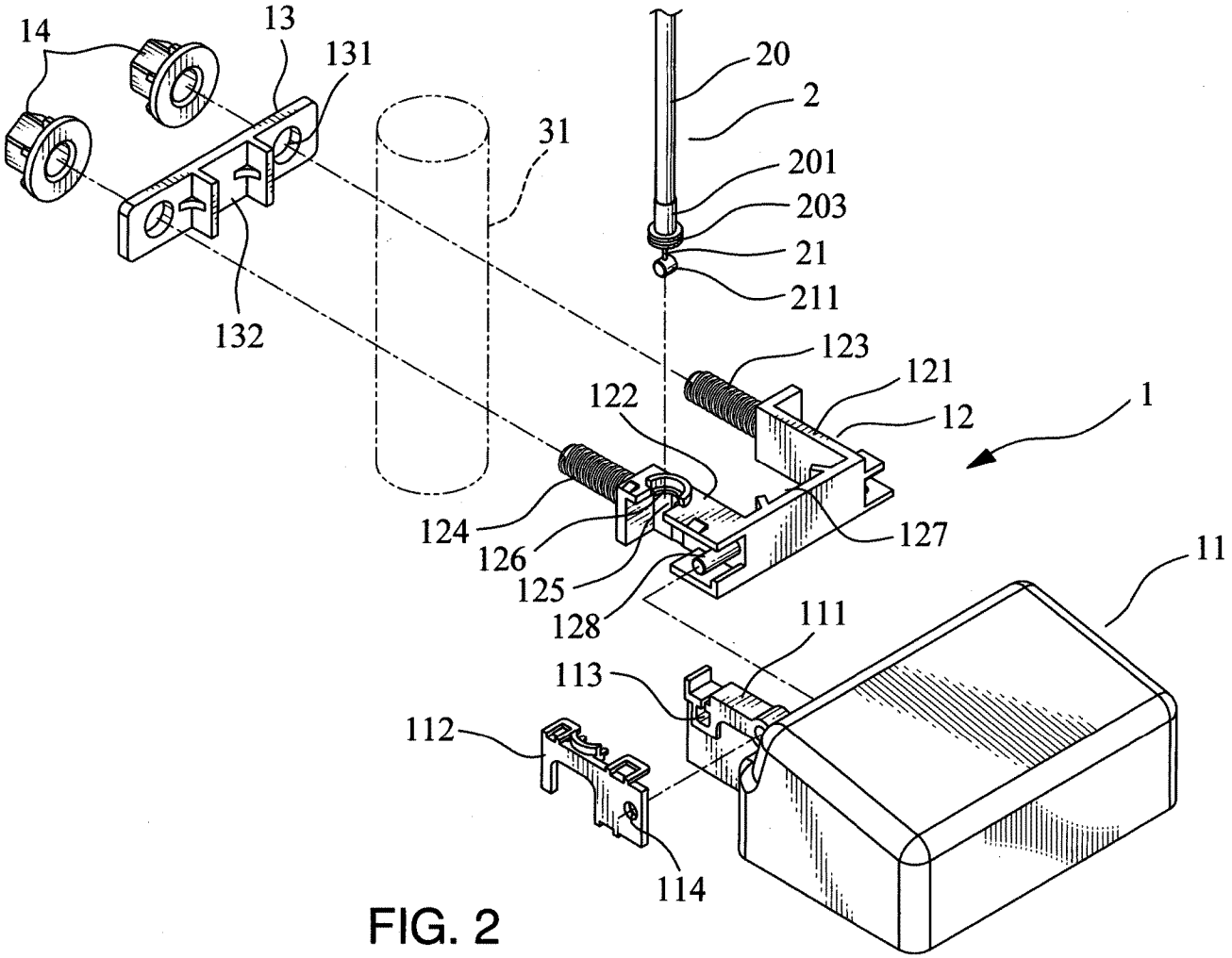
FIG. 2 is a three-dimension exploded diagram of the self-sealing actuating device of the present invention.
Figure 3:
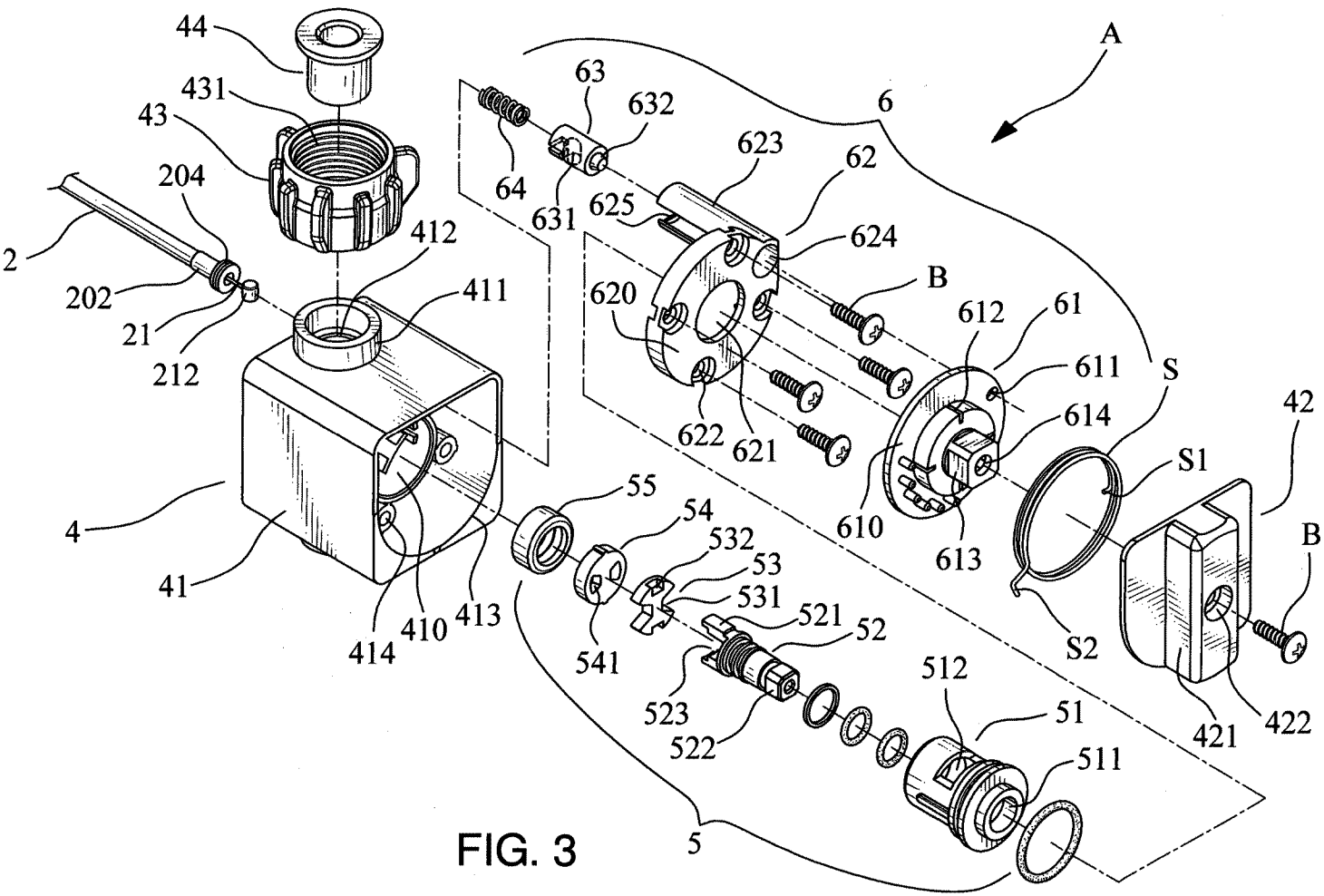
FIG. 3 is a three-dimension exploded diagram of the water control device of the present invention.
Figure 4:
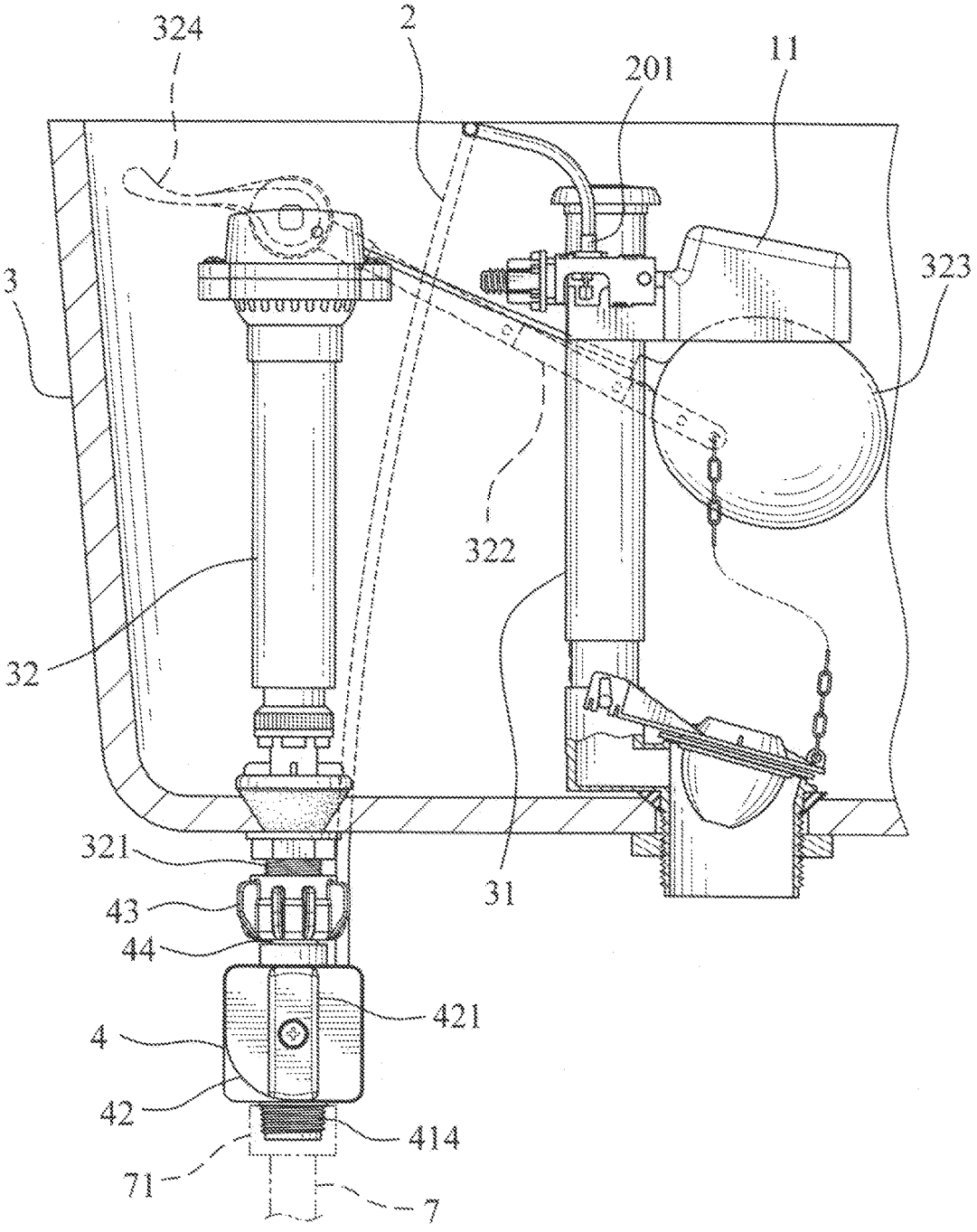
FIG. 4 is a schematic diagram of configuration of the present invention.
Figure 5:
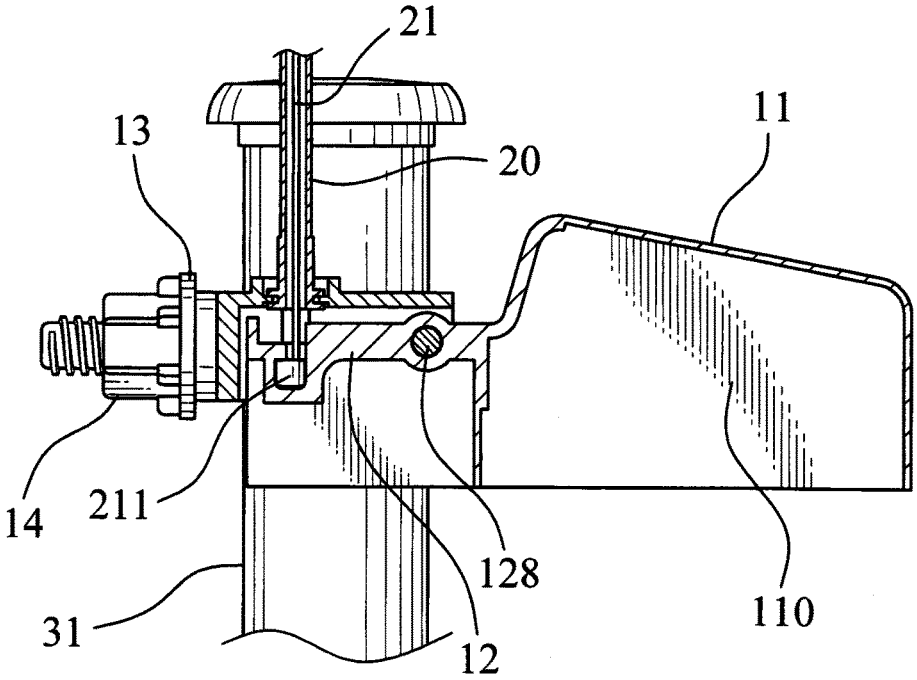
FIG. 5 is a schematic diagram of a normal state of the self-sealing actuating device of the present invention.
Figure 7:
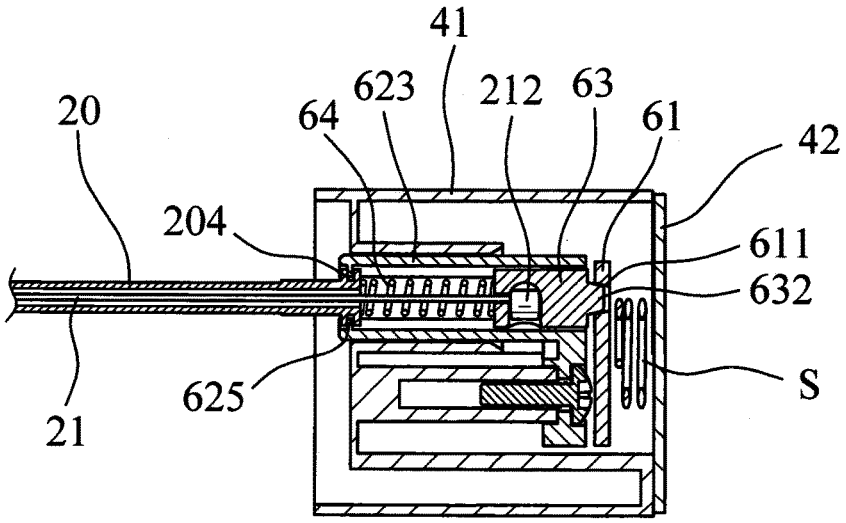
FIG. 7 is a schematic diagram of motion of the water control device without pulling by the inner string according to the present invention.
Figure 6:
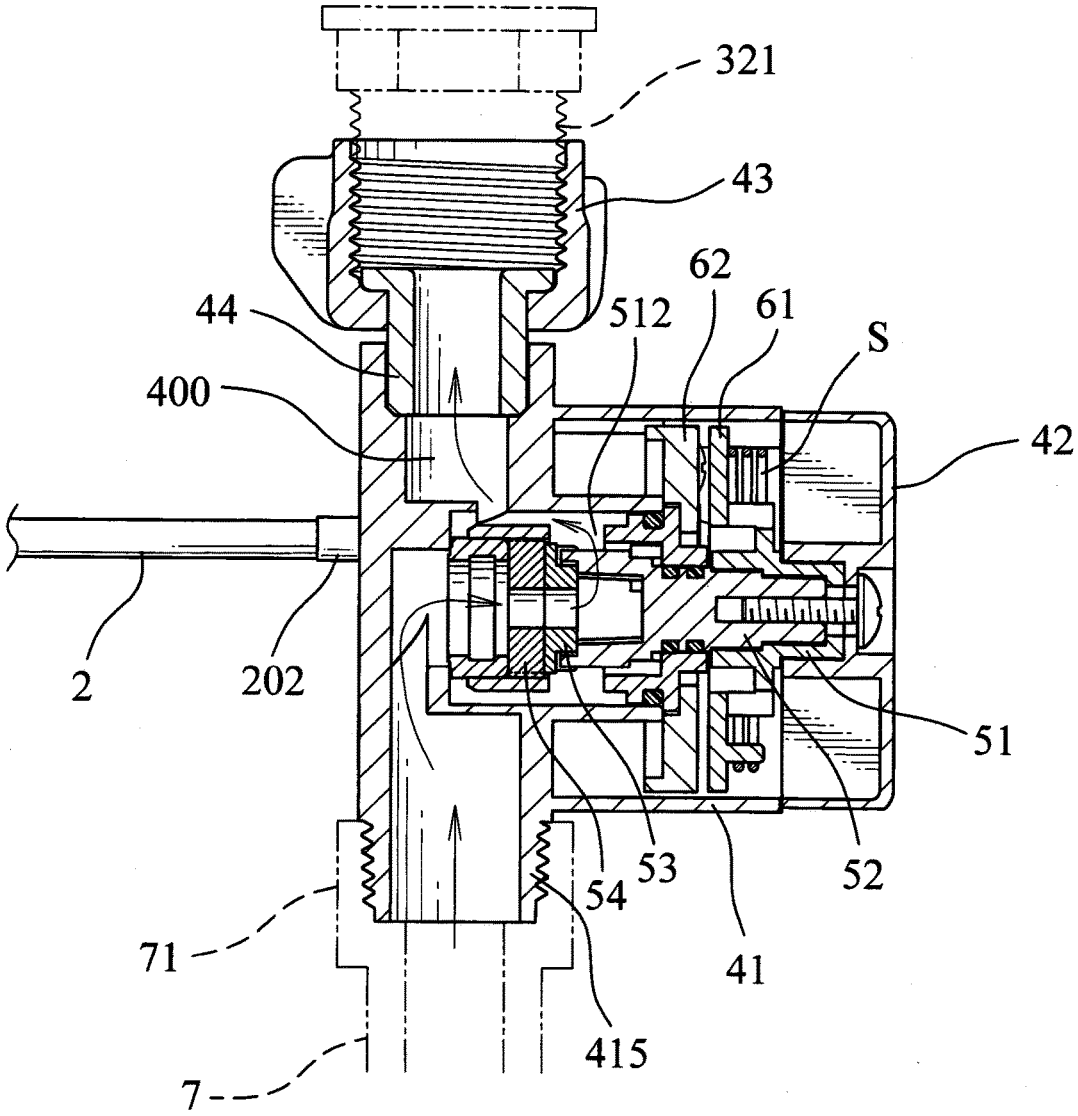
FIG. 6 is a schematic diagram of a normal state of the water control device of the present invention.

As shown in FIG. 1 to FIG. 7, the leak-proof structure of the toilet tank of the present invention, including a self-sealing actuating device, a string set and a water control device, wherein:

the self-sealing actuating device 1, which is installed on an upper side of an overflow pipe 31, the self-sealing actuating device 1 is consisted of a buoyant cover 11, a holder 12 and an outer fixed plate 13; the buoyant cover 11 has an inner containing space with a downward opening 110, a connecting arm 111 is extendedly connected to a side of the buoyant cover 11, an outer side arm 112 is connected to an outer side of the connecting arm 111, an inner shaft hole 113 is set on the connecting arm 111, an outer shaft hole 114 is set on the outer side arm 112, the outer shaft hole 114 is corresponded to the inner shaft hole 113; a first side arm 121, a second side arm 122 and a first holding portion 127 are set on the holder 12, a first bolt 123 is set on the first side arm 121; a second bolt, a first containing cavity 125 and a support shaft 128 are set on the second side arm 122, a first positioning rib 126 is set on the first containing cavity 125, the support shaft 128 is inserted into the inner shaft hole and the outer hole 114, two through holes 131 and a second holding portion 132 are set on the outer fixed plate 13, the overflow pipe 31 is held by the second holding portion 132 and the first holding portion 127 are correspondingly, to thereby fasten the self-sealing actuating device 1, the first bolt 123 and the second bolt 124 are inserted into the two through holes 131 and two locking nuts 14 are provided to fasten on respectively;

the string set 2, which is consisted of an outer tube 20 and an inner string 21, the outer tube 20 is a hollow tube body, a first joint 201 is set on an end of the outer tube 20, the first joint 201 is connected to the holder 12 of the self-sealing actuating device 1, a first positioning groove 203 is set on the first joint 201, the first positioning rib 126 is correspondingly embedded into the first positioning groove 203, a second joint 202 is set on another end of the outer tube 20, a second positioning groove 204 is set on the second joint 202, the inner string 21 is passed through inside the outer tube 20, two ends of the inner string 21 is outstretched out of two ends of the outer tube 20, a first gland 211 is set on the end of the inner string 21, the first gland 211 is placed inside the first containing cavity 125, a second gland 212 is set on another end of the inner string 21;

the water control device A, which is set on a connecting location of an inlet pipe 7 and a water inlet valve 32 on an outer bottom side of a toilet tank 3, the water control device A includes:

a water control box 4, which is consisted of a box body 41, a swiveling cover 42, a fixed nut 43 and an engaging tube 44; an inner containing room 410 is set inside the box body 41, multiple locking screw holes 414 are set on a peripheral edge of the inner containing room 410, an opening 413 is set on a side of the box body 41 for the swiveling cover 42 to cover, a grip portion 421 is set convexly on an outer side of the swiveling cover 42, a fixing hole 422 is set on the grip portion 421, an engaging flange 411 is set on a top side of the box body 41, the engaging flange 411 includes an open-end hole 412, an lower section of the engaging tube 44 is passed through the inner screw hole 431 of the fixed nut 43 and then placed into the open-end hole 412, a screw tube 321 is fastened to the inner screw hole 431 of the fixed nut, a screw pipe 415 is set on a bottom of the box body 41, the screw pipe 415 is fastened to a screw joint 71 of an inlet pipe 7;

a sealing valve 5, which is placed in the inner containing room 410 of the box body 41, the sealing valve 5 is consisted of an outer sleeve 51, a shaft 52, a movable slider 53, a fixed slider 54 and a pad 55, a shaft hole 511 is set on the outer sleeve 51, an outlet hole 512 is further set on a peripheral edge of the outer sleeve 51, a shaft head 522 is set on a upper section of the shaft 52, a shafting block 521 and an outlet notch 523 are set on a lower section of the shaft 52, the shaft head 522 is passed through the shaft hole 511, a shifting groove 532 and at least a gap 531 are set on the movable slider 53, the shifting block 521 is embedded in the shifting groove 532, the fixed slider 54 is attached to a bottom side of the movable slider 53, at least a water hole 541 is set on the fixed slider 54, the pad 55 is attached to a bottom side of the fixed slider 54;

a seat group 6, which is consisted of a disc seat 61, a fixed disc 62, a pushing block 63, a spring 64 and a torsion spring S, a positioning hole 611 is set on a peripheral edge of a disc body 610 of the disc seat 61, a stepped convex seat 613 is set in the center of the disc body 610, a fixing screw hole 614 and at least a positioning groove 612 are set on the stepped convex seat 613, the shaft head 522 of the shaft 52 is placed inside the stepped convex seat 613, the fixing screw hole 614 corresponded to the fixing hole 422 of the swiveling cover 42 is provided to fasten a bolt B, the torsion spring S is set between the disc seat 61 and the swiveling cover 42, an end S1 of the torsion spring S is located on the positioning groove 612, another end S2 is located on an inner side of the swiveling cover 42, a central hole 621 is set on the fixed disc 62, multiple fixed through holes 622 are set on a outer side of the central hole 621 of the disc side 620 of the fixed disc 62, multiple fixed through holes 622 are provided for the corresponding bolt B to pass through and fix to the locking screw hole 414, a side sleeve 623 is set on the disc side 620, the side sleeve 623 includes a mounting hole 624, a second positioning rub 625 is set on an end of the mounting hole 624, the second positioning rib 625 is correspondingly embedded in the second positioning groove 204, the pushing block 63 is placed in the mounting hole 624, a second containing cavity 631 set on a peripheral edge of the pushing block 63 is provided to place the second gland 212 of the inner string 21, a column 632 is set on a front end of the pushing block 63, the column 632 is corresponded to the positioning hole 611, the spring 64 is passed through by the inner string 21, the spring 64 is touched a bottom of the pushing block 63.

By the composition of above elements, under normal state (as shown in FIG. 4 to FIG. 7), after the flush handle 324 is pushed and normal flushing of the toilet tank 3 is completed, water operation of the water inlet valve 32 is that water flows into the box body 41 from the inlet pipe7, water flows from the water hole 541 of the fixed slider 54 of the sealing valve 5, the gap 531 of the movable slider 53 (in water location), and water flows out from the outlet hole 512 of the outer sleeve 51 and flows into the water inlet valve 32 for watering. When full water level is achieved, the connecting rod 322 drives the water inlet valve 32 to stop watering due to buoyancy of the floating ball 313.

Figure 8:
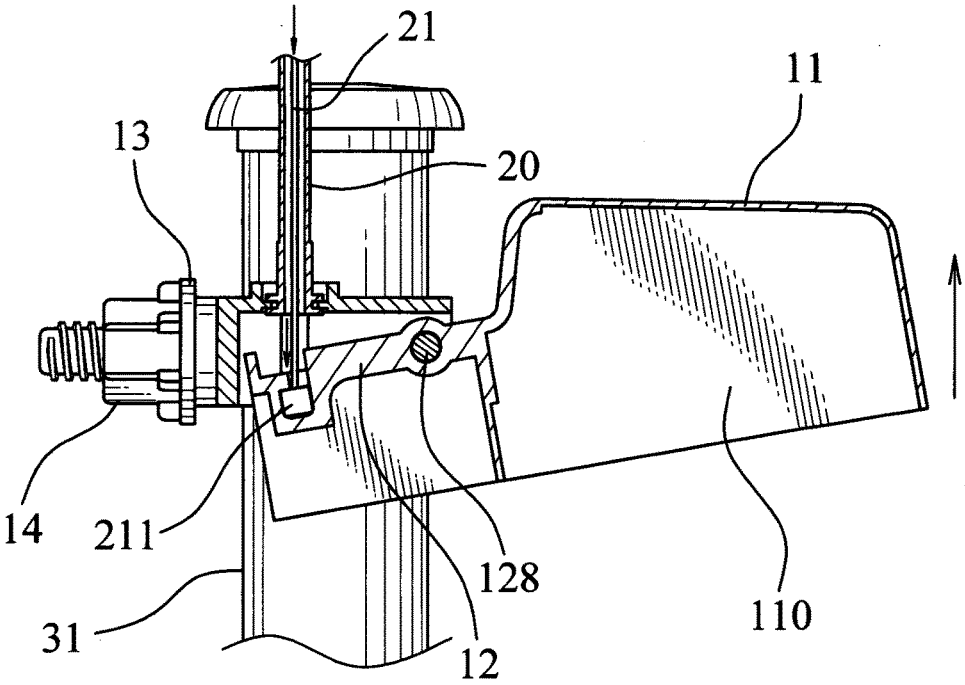
FIG. 8 is a schematic diagram of motion of the self-sealing actuating device of the present invention.
Figure 9:
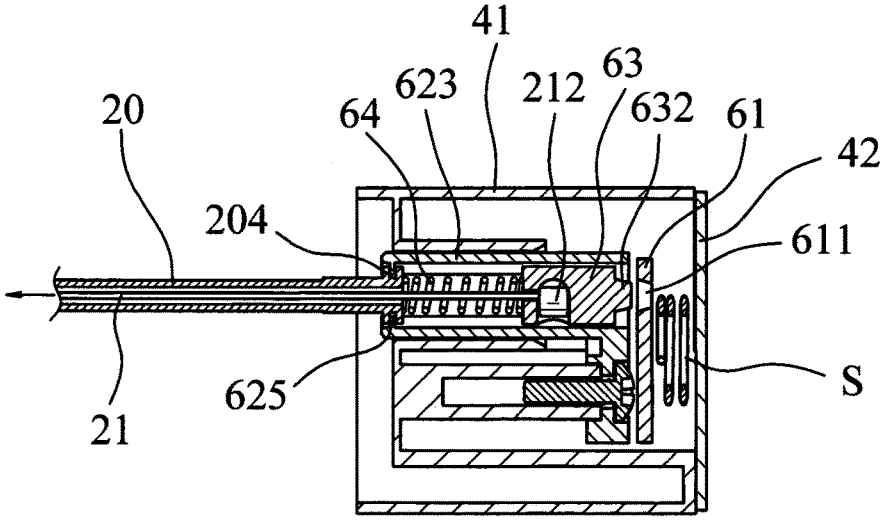
FIG. 9 is a schematic diagram of motion of the water control device pulling by the inner string according to the present invention.
Figure 10:
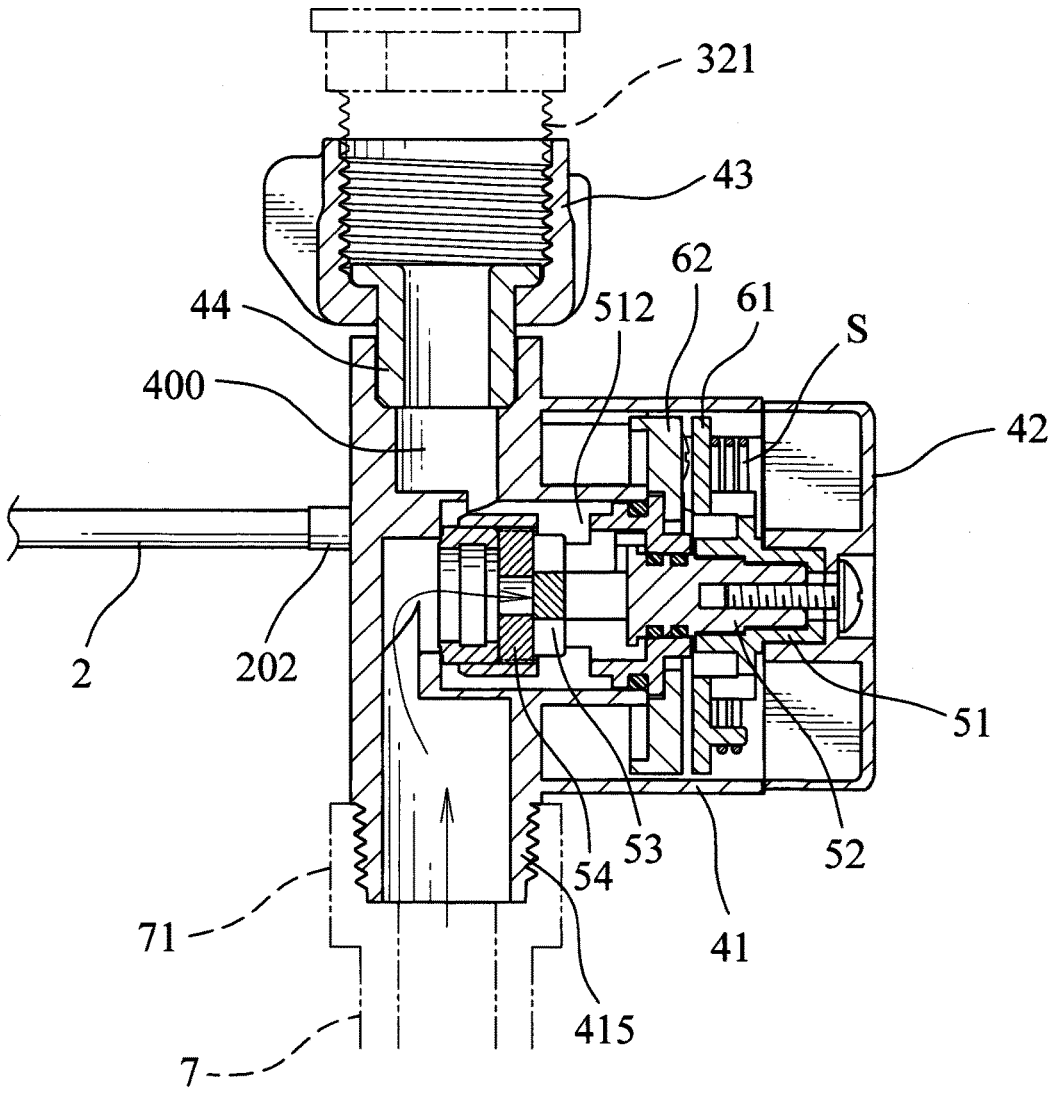
FIG. 10 is a schematic diagram of motion of the water control device of the present invention.

When the water inlet valve 32 waters normally, the touched position of the buoyant cover 11 is higher than the predetermined stopped water line. Thus, when the connecting rod 322 is driven by the floating ball 323 to stop the water inlet valve 32 watering, the buoyant cover 11 does not affect to touch the sealing valve 5 of the water control device A to stop watering. Only when the water inlet valve 32 is failure, the water inlet valve 32 waters continuously. If water level is higher than the stopped water line for about 20 mm to 25 mm, the buoyant cover 11 pulls the inner string 21 due to buoyancy force (as shown in FIG. 8, 9, 10), the column 632 on the front end of the pushing block 63 escapes from the positioning hole 611, at the time, the torsion spring S drives the shaft 52 of the sealing valve 5 rotating by its elastic restoring force, so that the movable slider 53 moves to a stopping position and water cannot flow through, at this time, there is no water flowing into the toilet tank 3, thus automatic stop-leaking purpose is achieved. When flushing again, the user may find that there is no water in the toilet tank 3 and then know that the water inlet valve 32 is failure, and he has to check, repair or change a water inlet valve 32.

When the water inlet valve 32 is repaired, the user has to rotate the swiveling cover 42 to a watering position by fingers for watering. During the process of rotating the swiveling cover 42, the torsion spring S is rotated to a compressed state by the rotating force, the spring 64 synchronously pushes the column 632 of the pushing block 63 into the positioning hole 611 for locking by its elasticity, and the shaft 52 is rotated to a watering position by the force of rotating the swiveling cover 42, so that water flows into the water inlet valve 32 and flows into the toilet tank 3 from the water inlet valve 32 until water level arrives to the full water level. The connecting rod 32 is driven to stop water flowing from the water inlet valve 32 by buoyancy force of the floating ball 323.

Above all, in the leak-proof structure of the toilet tank of the present invention, when the water inlet valve is failure, the string set is connected by the self-sealing actuating device to drive the sealing valve of the water control device for stopping water, to achieve the automatic stop-leak effect. Thus, the drawback may be solved effectively. Also, technical features of the present invention has not disclosed before, thus the present invention is novel and progressive.

What is claimed is:

1. A leak-proof structure of a toilet tank, including a self-sealing actuating device, a string set and a water control device, wherein:

the self-sealing actuating device, which is installed on an upper side of an overflow pipe, the self-sealing actuating device is consisted of a buoyant cover, a holder and an outer fixed plate, a connecting arm is extendedly connected to a side of the buoyant cover, an inner shaft hole is set on the connecting arm; a first side arm, a second side arm and a first holding portion are set on the holder, a first containing cavity and a support shaft are set on the second side arm, the support shaft is inserted into the inner shaft hole, a second holding portion is set on the outer fixed plate, the overflow pipe is held by the second holding portion and the first holding portion are correspondingly, to thereby fasten the self-sealing actuating device;

the string set, which is consisted of an outer tube and an inner string, the outer tube is a hollow tube body, a first joint is set on an end of the outer tube, the first joint is connected to the holder of the self-sealing actuating device, a second joint is set on another end of the outer tube, the inner string is passed through inside the outer tube, two ends of the inner string is outstretched out of two ends of the outer tube, a first gland is set on the end of the inner string, the first gland is placed inside the first containing cavity, a second gland is set on another end of the inner string;

the water control device, which is set on a connecting location of an inlet pipe and a water inlet valve on an outer bottom side of the toilet tank, the water control device includes:

a water control box, which is consisted of a box body, a swiveling cover, a fixed nut and an engaging tube; an inner containing room is set inside the box body, the swiveling cover is covered on a side of the box body, an open-end hole is set on a top side of the box body, an lower section of the engaging tube is passed through the fixed nut and then placed into the open-end hole, the fixed nut is fastened to a screw tube, a screw pipe is set on a bottom of the box body, the screw pipe is fastened to an inlet pipe;

a sealing valve, which is placed in the inner containing room of the box body, the sealing valve is consisted of an outer sleeve, a shaft, a movable slider, a fixed slider and a pad, a shaft hole is set on the outer sleeve, an outlet hole is further set on a peripheral edge of the outer sleeve, a shaft head is set on a upper section of the shaft, a shafting block and an outlet notch are set on a lower section of the shaft, the shaft head is passed through the shaft hole, a shifting groove and at least a gap are set on the movable slider, the shifting block is embedded in the shifting groove, the fixed slider is attached to a bottom side of the movable slider, at least a water hole is set on the fixed slider, the pad is attached to a bottom side of the fixed slider;

a seat group, which is consisted of a disc seat, a fixed disc, a pushing block, a spring and a torsion spring, a positioning hole is set on a peripheral edge of a disc body of the disc seat, a stepped convex seat is set in the center of the disc body, the shaft head of the shaft is placed inside the stepped convex seat, the torsion spring is set between the disc seat and the swiveling cover, a central hole is set on the fixed disc, a side sleeve is set on a side of the fixed disc, the side sleeve includes a mounting hole, the pushing block is placed in the mounting hole, a second containing cavity set on a peripheral edge of the pushing block is provided to place the second gland of the inner string, a column is set on a front end of the pushing block, the column is corresponded to the positioning hole, the spring is passed through by the inner string, the spring presses against a bottom of the pushing block.

2. The leak-proof structure of the toilet tank as claimed in claim 1, wherein the buoyant cover includes an inner containing space with a downward opening.

3. The leak-proof structure of the toilet tank as claimed in claim 1, wherein an outer side arm is connected to an outer side of the connecting arm, an inner shaft hole is set on the connecting arm, an outer shaft hole is set on the outer side arm, the outer shaft hole is corresponded to the inner shaft hole.

4. The leak-proof structure of the toilet tank as claimed in claim 1, wherein a positioning rib of the holder is set on the first containing cavity, the positioning rib of the holder is correspondingly embedded into the positioning groove of the first joint of the string set.

5. The leak-proof structure of the toilet tank as claimed in claim 1, wherein a grip portion is set convexly on an outer side of the swiveling cover.

6. The leak-proof structure of the toilet tank as claimed in claim 1, wherein a fixing screw hole and at least a positioning groove are set on the stepped convex seat.

7. The leak-proof structure of the toilet tank as claimed in claim 1, wherein a positioning rib of the fixed disc is set on an end of the mounting hole, the positioning rib of the fixed disc is correspondingly engaged with a positioning groove of the second joint of the string set.

* * * * *